US007992841B2

(12) United States Patent
Petta et al.

(10) Patent No.: US 7,992,841 B2
(45) Date of Patent: Aug. 9, 2011

(54) SLIDE CONNECTOR AND RAILING SYSTEM INCORPORTING SAME

(75) Inventors: Gabriel Petta, Woodbridge (CA); Rolf J. Ohrstrom, Toronto (CA)

(73) Assignee: Alpa Lumber Inc., Mississauga (CA)

( * ) Notice: Subject to any disclaimer, the term of this patent is extended or adjusted under 35 U.S.C. 154(b) by 132 days.

(21) Appl. No.: 12/343,917

(22) Filed: Dec. 24, 2008

(65) Prior Publication Data

US 2009/0134378 A1 May 28, 2009

Related U.S. Application Data

(62) Division of application No. 11/449,615, filed on Jun. 9, 2006, now abandoned.

(60) Provisional application No. 60/689,074, filed on Jun. 10, 2005.

(51) Int. Cl.
*E04H 17/00* (2006.01)

(52) U.S. Cl. ..... 256/65.07; 256/65.08; 256/65.13; 403/329; 24/593.1

(58) Field of Classification Search ..... 403/326, 403/329; 256/59, 65.01, 65.02, 65.03, 65.04, 256/65.05, 65.06, 65.07, 65.08, 65.13, 65.16; 248/220.1, 220.21; 24/572.1, 591.1, 593.1, 24/596.1, 700; 312/108, 111, 265.1, 265.5; 211/186, 189

See application file for complete search history.

(56) References Cited

U.S. PATENT DOCUMENTS

| | | | | |
|---|---|---|---|---|
| 2,608,386 A | | 5/1946 | Hart | |
| 3,136,530 A | | 6/1964 | Case | |
| 3,343,811 A | * | 9/1967 | Kusel et al. | 256/65.08 |
| 3,385,567 A | | 5/1968 | Case et al. | |
| 3,388,884 A | | 6/1968 | Eggler et al. | |
| 3,398,981 A | | 8/1968 | Vincens | |
| 3,403,641 A | * | 10/1968 | Baker | 312/111 |
| 3,490,797 A | * | 1/1970 | Platte | 52/282.1 |
| 3,498,589 A | | 3/1970 | Murdock | |
| 3,506,243 A | | 4/1970 | Seiler | |
| 3,610,427 A | | 10/1971 | Maziarka et al. | |
| 3,617,077 A | * | 11/1971 | Cavanaugh, Sr. | 403/329 |
| 3,618,993 A | * | 11/1971 | Platte | 403/326 |
| 3,752,553 A | | 8/1973 | Bidahl et al. | |
| 3,756,567 A | | 9/1973 | Murdock | |
| 3,931,946 A | | 1/1976 | Soltysik | |

(Continued)

FOREIGN PATENT DOCUMENTS

CA 2157325 3/1997

(Continued)

*Primary Examiner* — Michael P Ferguson
(74) *Attorney, Agent, or Firm* — Bereskin & Parr LLP/S.E.N.C.R.L., s.r.l.

(57) ABSTRACT

A combination of a rail, an upright, and a slide connector for attaching the rail to the upright includes a first connector part including a mounting arm secured to an underside surface of the rail adjacent one end thereof and a tongue depending generally downwardly from the mounting arm, and a second connector part including a mounting base secured to a side surface of the upright and a generally planar engagement body extending laterally outwardly from the mounting base. The engagement body has a slot therein for receiving the tongue when the rail is translated along an engagement axis from a disengaged position in which the first and second parts are generally free to move relative to each other to an engaged position in which the first and second parts are substantially inhibited from moving relative to each other, thereby attaching the rail to the upright.

7 Claims, 9 Drawing Sheets

U.S. PATENT DOCUMENTS

| | | | | | |
|---|---|---|---|---|---|
| 4,148,454 | A | | 4/1979 | Carlson et al. | |
| 4,189,796 | A | | 2/1980 | Gutner | |
| 4,266,757 | A | * | 5/1981 | Kirkwood | 256/65.04 |
| 4,340,199 | A | | 7/1982 | Brock | |
| 4,389,133 | A | | 6/1983 | Oberst | |
| 4,480,854 | A | * | 11/1984 | Doty | 24/171 |
| 4,565,465 | A | | 1/1986 | Oberst | |
| 4,797,020 | A | | 1/1989 | Winston | |
| 4,809,955 | A | | 3/1989 | Veilleux | |
| 4,919,394 | A | | 4/1990 | Otte et al. | |
| 4,929,116 | A | | 5/1990 | Mahl | |
| 4,976,567 | A | | 12/1990 | Spier | |
| 5,284,359 | A | | 2/1994 | Baba | |
| 5,533,237 | A | | 7/1996 | Higgins | |
| 5,544,866 | A | | 8/1996 | Dye | |
| 5,713,171 | A | | 2/1998 | Andres | |
| 6,398,193 | B1 | | 6/2002 | DeSouza | |
| 6,698,726 | B2 | | 3/2004 | Platt | |
| 6,702,259 | B2 | | 3/2004 | Pratt | |
| 6,874,766 | B2 | | 4/2005 | Curatolo | |
| 2004/0188666 | A1 | | 9/2004 | Pratt | |

FOREIGN PATENT DOCUMENTS

| | | |
|---|---|---|
| CA | 2363976 | 5/2003 |
| DE | 7707911 | 7/1977 |
| EP | 754600 | 1/1997 |
| JP | 9195476 | 7/1997 |

* cited by examiner

SLIDE CONNECTOR AND RAILING SYSTEM INCORPORTING SAME

This application is a division of prior U.S. application Ser. No. 11/449,615, filed Jun. 9, 2006, which claims the benefit of Provisional Application No. 60/689,074, filed Jun. 10, 2005, each of which is incorporated herein by reference.

FIELD

The present specification relates to a slide connector for attaching a railing to an upright and to a railing system incorporating a slide connector.

BACKGROUND

Canadian Published Patent Application No. 2,157,325 (Parisien) discloses a balcony or porch rail system having top and bottom rails and end posts. Each of the rails is secured to the post by a bracket received in the end of the rail and secured to a washer received in the post and secured to the bracket by a bolt extending through a partially open front wall of the post.

U.S. Published Patent Application No. 2004/018666 (Pratt) discloses a guard rail system having a lower rail, a two-piece upper rail, and balusters to form a rail section. The rail section is fastened to end posts, preferably using mounting brackets having a flanged arm.

SUMMARY

The following summary is intended to introduce the reader to this specification but not to define any invention. In general, this specification discusses one or more methods or apparatuses for providing a system for securing railings to an upright that can simplify and speed up the installation process of a railing system. The present specification can eliminate or reduce accessibility problems associated with installing fasteners into railings and/or uprights with the railings and uprights positioned adjacent each other generally in their as-installed positions. The present specification also provides a railing system with improved aesthetics by increasing the concealment of hardware used to attach the railings to the uprights.

According to a first aspect of the present specification, a slide connector apparatus for attaching a rail to an upright is provided. The apparatus includes a first part adapted to be secured to the rail and having a first engagement element, and a second part adapted to be secured to the upright and having a second engagement element. The first and second engagement elements are movable along an engagement axis from a disengaged position, in which the first and second parts are generally free to move relative to each other, to an engaged position in which the first and second parts are substantially inhibited from moving relative to each other.

The first and second parts can be adapted to be secured to the rail and upright, respectively, prior to moving the first and second engagement elements into the engaged position. The engagement axis can be defined by a generally straight line extending in a generally vertical plane, and can be a vertical line. The first and second engagement elements can each comprise a respective one of a tongue member and a cavity for receiving the tongue member. The tongue member can extend parallel to the engagement axis. The first and second engagement elements can each comprise a respective one of a barb and a catch, the barb adapted to abut the catch for preventing reverse relative movement of the first and second parts from the engaged position to the disengaged position.

According to another aspect of the present specification, a railing system is provided. The railing system includes a lower rail, an upper rail, and spaced-apart balusters extending generally vertically between the lower and upper rails. The lower and upper rails extend between uprights provided at either end thereof. The railing system further includes a slide connector apparatus as described above for securing the railings to the uprights. Each rail can have a pocket in its underside for receiving the first part of the slide connector apparatus. The pocket can have a central elongate boss for receiving fasteners, and anchoring grooves for receiving upstanding support legs of the first part to facilitate securing the first part to the rail.

According to another aspect of the present specification, a method for installing a railing system and a method for securing railings to uprights of a railing system is provided. The method includes securing the first part of a connector apparatus to a railing prior to positioning the railing in the "as-installed" position relative to the post. The method also includes securing the second part of a connector apparatus to the upright prior to positioning the railing in the "as-installed" position relative to the upright. After securing the first and second parts to the railing and uprights, respectively, the railing can be positioned between the posts, with the first part in vertical registration with, and above, the second part. The rail can then be moved downward along an engagement axis to couple together the first and second parts.

According to another aspect, a slide connector for attaching a rail to an upright includes a first part adapted to be mounted to a rail and having a first engagement element; and a second part adapted to be mounted to an upright and having a second engagement element, the first and second engagement elements adapted to be coupled by moving the second engagement element in a direction parallel to a generally vertical plane into contact with the first engagement element.

The first and second engagement elements can each comprise a respective one of a tongue member and a cavity adapted to receive the tongue member. The first part can comprise a mounting arm adapted to be secured to an underside surface of the rail, the first engagement element depending from the mounting arm and defining the tongue. The mounting arm and tongue can be disposed at an angle relative to each other to match a relative angle between the rail and upright. The second part can comprise a mounting base adapted to be secured to a side surface of the upright, the second engagement element extending from the mounting base and defining the cavity. The second engagement element and mounting base can be generally perpendicular relative to each other. The second engagement element can define a support perimeter around the cavity, the second engagement element can include a barb extending from the support perimeter inwardly of the cavity. The first engagement element can comprise a retention aperture in the tongue, the barb adapted to invade the retention aperture upon insertion of the tongue into the cavity. The second engagement element can comprise at least one pressure tab extending inwardly of the cavity from a side of the cavity generally opposite the barb and laterally offset with respect to the barb to urge the tongue towards the barb.

Other aspects and features of the present specification will become apparent, to those ordinarily skilled in the art, upon review of the following description of the specific examples of the specification.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an example of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
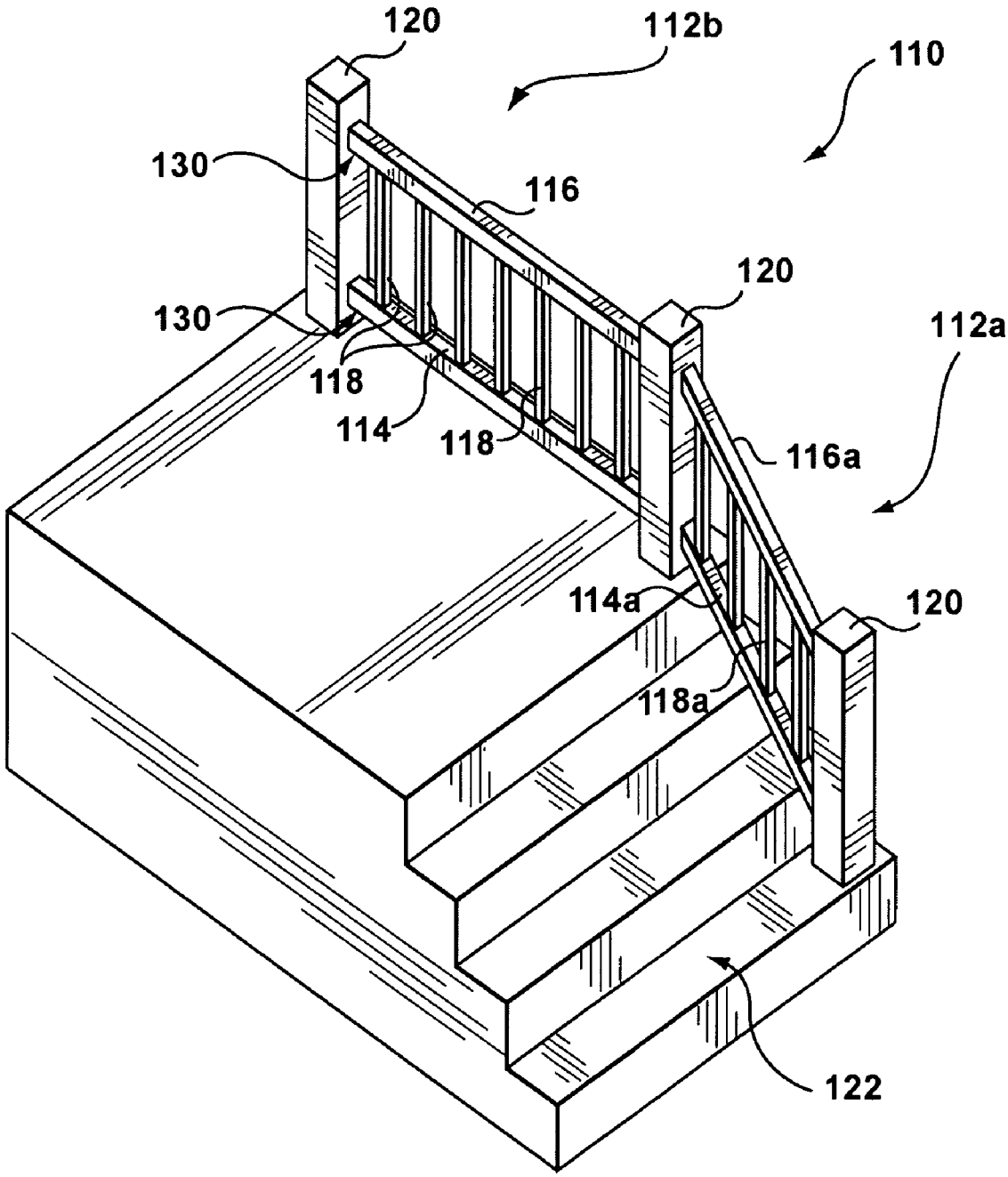
FIG. 1 is a perspective view of a railing system in accordance with the present specification.

A railing system 110 in accordance with the applicant's teaching can be seen in FIG. 1. The railing system 110 can have a number of sections 112*a*, 112*b*, each of which includes a lower rail 114, an upper rail (or handrail) 116, and a series of spindles or balusters 118 extending generally vertically between the lower and upper rails. The sections 112*a*, 112*b* typically span a horizontal distance between a pair of uprights 120. The sections 112*a*, 112*b* can be inclined, such as, for example, section 112*a* for installation along a staircase 122, or can be generally horizontal, such as, for example, section 112*b* for installation along a porch 124. The uprights 120 can be in the form of columns, posts, or a wall of an adjacent building or structure, and generally provide structural support for the railing system 110. The lower and upper rails of the inclined section 112*a* can have tapered ends and can be designated as lower rail 114*a*, upper rail 116*a*, with balusters 118*a*, extending therebetween.

The lower and upper rails 114, 116 can be substantially non-deformable to provide a sturdy look and feel to the railing system 110. Preferred materials include wood or a rigid wood composite material. In the example illustrated, the lower and upper rails 114, 116 are constructed of a wood-plastic composite with a vinyl cladding. This construction can provide a low-maintenance railing system having sufficient load bearing capacity and a non-deforming, sturdy feel when grasped by a user. Elements of the railing system 110 constructed of wood plastic composite can advantageously be manufactured by an extrusion process.

To produce the railing system 110, it can be advantageous to pre-assemble the sections 112*a*, 112*b* of the railing system 110. The term "pre-assembly" is used to generally refer to operations that can be performed in a manufacturing facility, rather than on-site (e.g. in a shop rather than at a home, for example, where the railing system 110 is to be installed). Pre-assembly of the sections 112*a*, 112*b* can include providing the lower and upper rails 114, 116 at the required length by, for example, cutting extruded lineals to length to fit between adjacent uprights 120. Also, the balusters 118 can be attached to the lower and upper rails 114, 116 by, for example, installing fasteners through the respective rails 114, 116 and into respective ends of the balusters 118. These pre-assembly operations can advantageously be done in a manufacturing facility to enhance product quality and to minimize cost, and can be of particular benefit in high volume production situations, such as when providing the railing system 110 at each home in a newly built subdivision.

Once the sections 112*a*, 112*b* have been pre-assembled, they can be delivered to the field for installation and attachment to the uprights 120. It is generally desirable that the sections 112*a*, 112*b* be secured to the uprights 120 in a manner that provides a sufficiently strong connection and that is relatively quick so as to keep installation time and associated costs to a minimum. It is also often desirable that the attachment of the sections 112*a*, 112*b* to the uprights 120 provide a connection that is generally concealed from view to enhance the aesthetics of the installed railing system 110.

Figure 2:
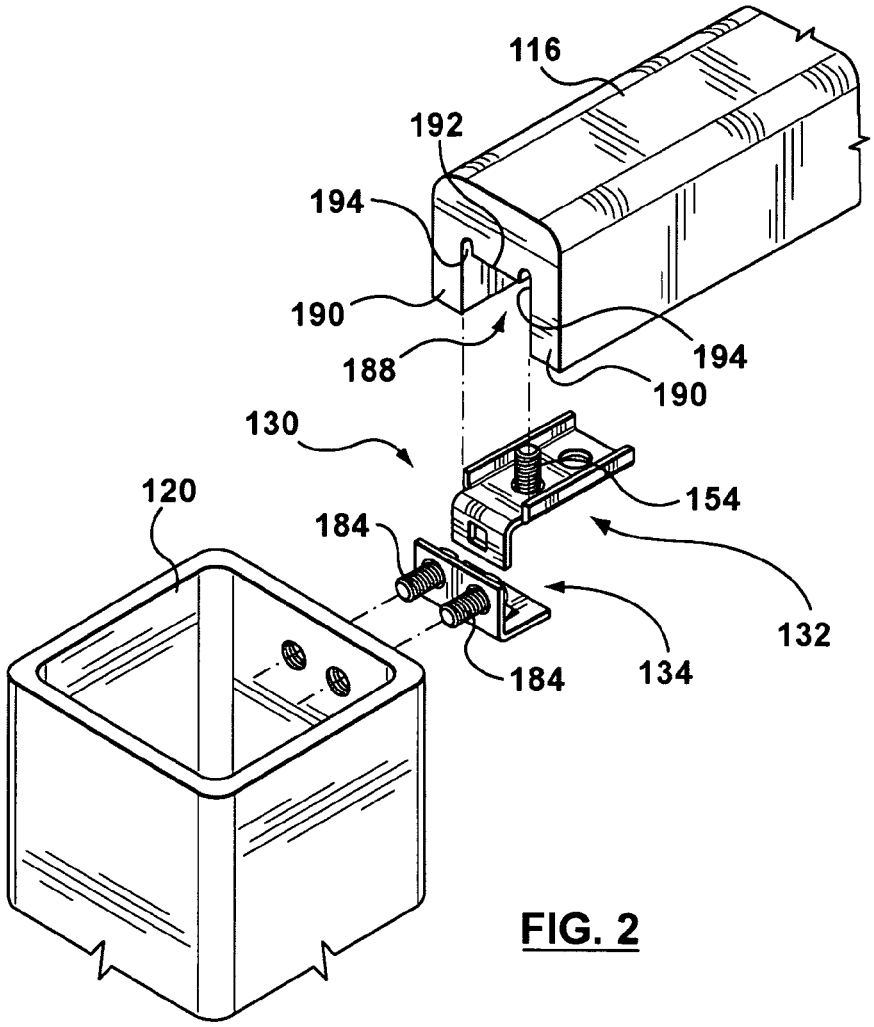
FIG. 2 is an exploded perspective view showing an enlarged portion of the system of FIG. 1.

As seen in FIG. 2, in accordance with the present specification, a slide connector 130 is provided for securing the sections 112*a*, 112*b* to the uprights 120. The connector 130 is adapted to provide assembly of the sections 112*a*, 112*b* to (for example) a pair of adjacent uprights 120 by translation of the sections 112*a*, 112*b* between adjacent uprights 120.

The connector 130 includes a first part (also referred to as an angle bracket) 132 adapted to be mounted to at least one of the rails 114, 116, and a second part (also referred to as a keeper) 134 adapted to be mounted to one of the uprights 120. In the example illustrated, connectors 130 are placed at both longitudinal ends of each of the upper and lower rails 114, 116, making for a total of four connectors 130 used to attach the sections 112*a*, 112*b* to the adjacent uprights 120.

Figure 3:
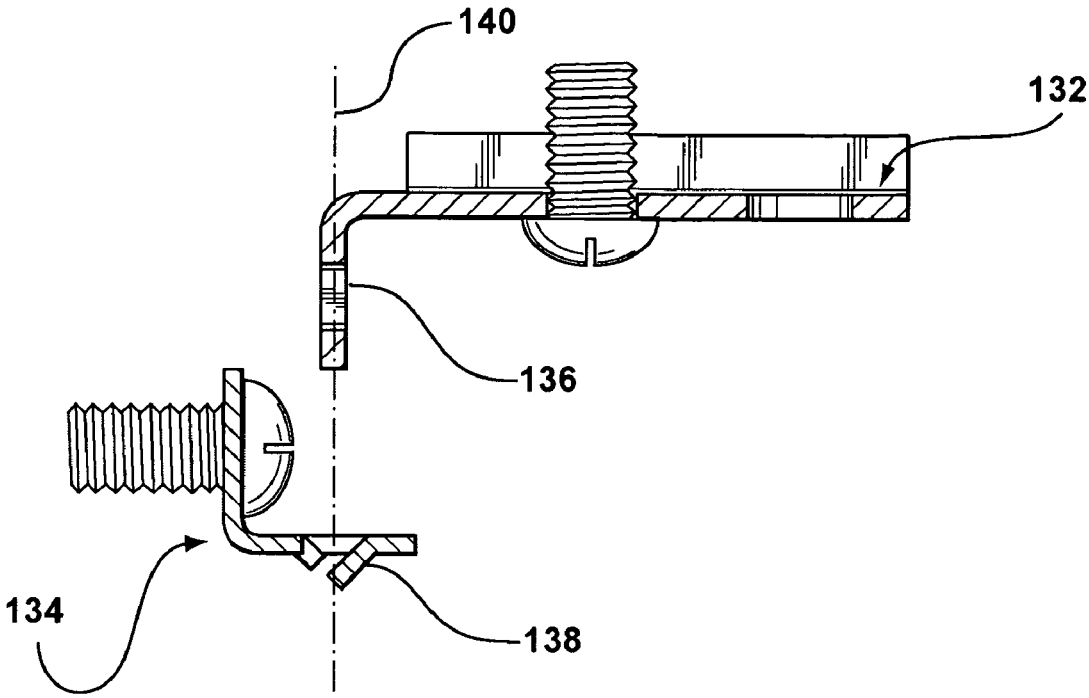
FIGS. 3 and 4 show a side view of a connector apparatus of the system of FIG. 1 in a disengaged and engaged position, respectively.
Figure 4:
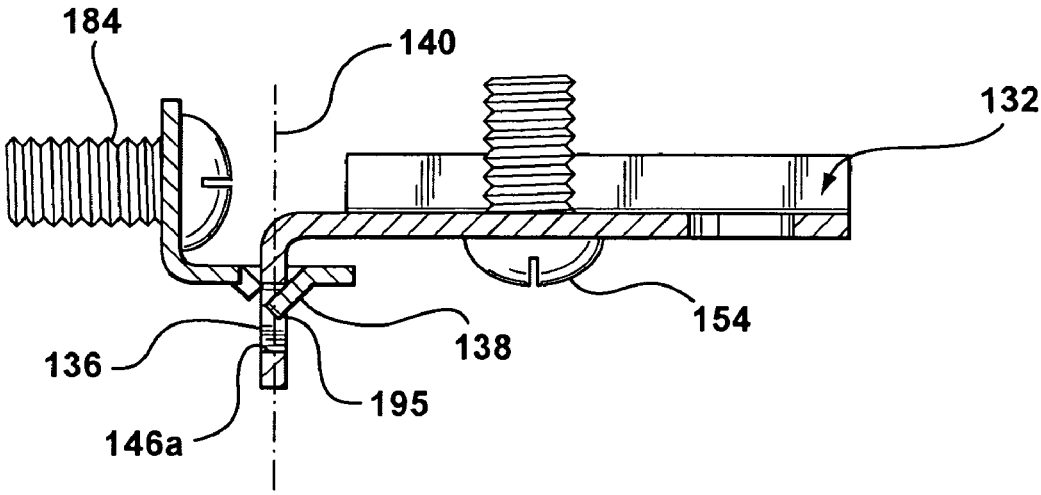

Referring now to FIG. 3, the angle bracket 132 has a first engagement element 136 and the keeper 134 has a second engagement element 138. The first and second engagement elements 136, 138 are adapted to be moved into an engaged position by relative translation towards each other along an engagement axis 140. When in the engaged position (FIG. 4), the first and second engagement elements 136, 138 are interengaged so that further relative motion (in any direction) is inhibited and the angle bracket 132 and keeper 134 are securely coupled.

To facilitate installation of the railings 114, 116 between a pair of generally vertical uprights 120, the engagement axis 140 of the connector 130 is generally parallel to a vertical plane. As well, where more than one connector 130 is used to secure the sections 112*a*, 112*b* to a pair of uprights 120, the engagement axes 140 of the connectors 130 will have a generally common direction.

Figure 5:
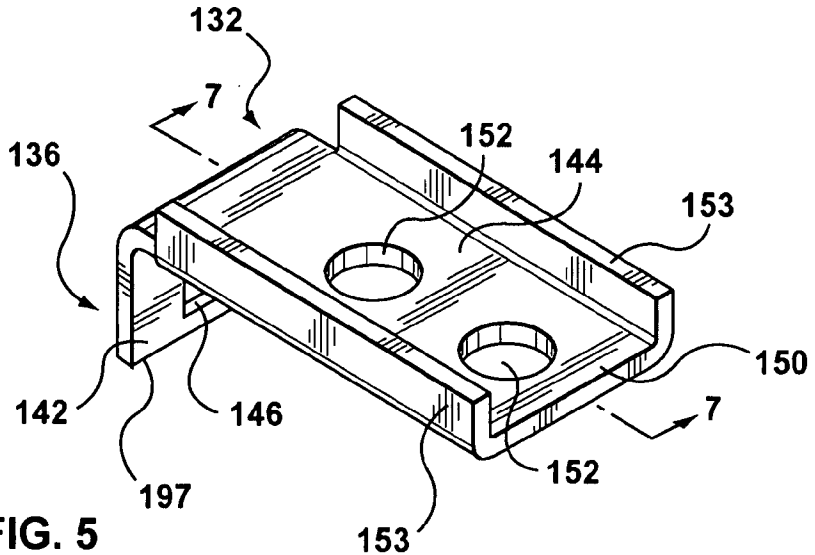
FIG. 5 is a perspective view of a first part of the connector apparatus of FIGS. 3 and 4.
Figure 6:
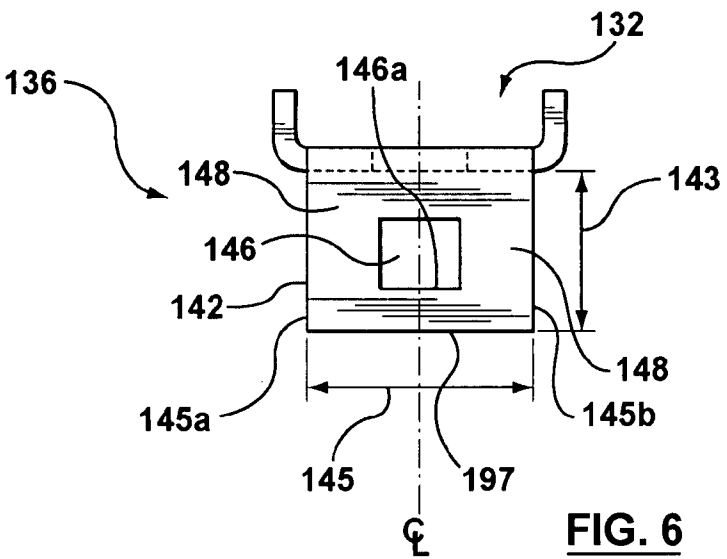
FIG. 6 is a front view of the first part of FIG. 5.
Figure 7:
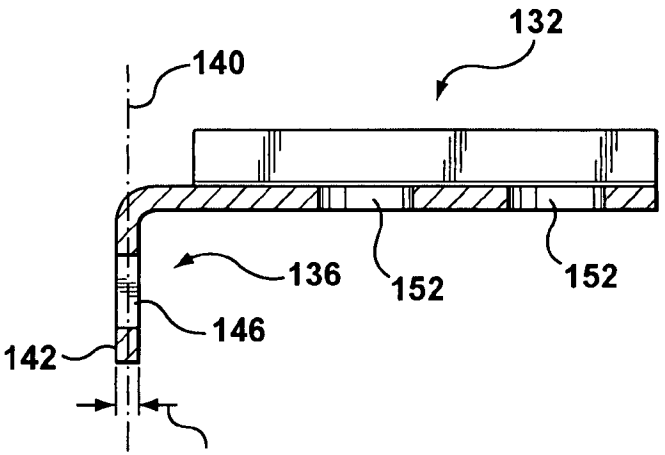
FIG. 7 is a side view in cross-section of the first part of FIG. 5, taken along the lines 7-7.

As best seen in FIGS. 5, 6, and 7, in the illustrated example the first engagement element 136 of the angle bracket 132 comprises a tongue member 142 that is joined to a mounting arm 144 of the angle bracket 132. The tongue member 142 is adapted to protrude in a direction along the engagement axis 140. In the example illustrated, the tongue member 142 has a generally planar configuration, and is adapted to extend vertically downwards in the installed railing system 110. The tongue member 142 has a height 143 measured from the mounting arm 144 to a lowermost or leading edge of the tongue 142. The tongue member 142 has a width 145 extending between opposed side edges 145*a* and 145*b*, and a thickness 147. The tongue member 142 can be provided with a first retaining element, such as, for example, but not limited to, an aperture 146, to facilitate retaining the first and second engagement elements 136, 138 in the engaged position. An area of the tongue member 142 adjacent the aperture 146 generally defines a bearing surface 148. An explanation of the function of the aperture 146 and bearing surface 148 is provided subsequently herein.

The mounting arm 144 of the angle bracket 132 is adapted to be secured to the railing 114, 116, adjacent one longitudinal end thereof. In the example illustrated, the mounting arm 144 includes a generally flat base member 150 having at least one aperture 152 through which a fastener 154 can pass for securing the mounting arm 144 to the underside of the rail 114, 116. In other examples (not illustrated), the angle bracket 132 can be adapted to be secured to the top or a side surface of the railing 114, 116. The mounting arm 144 can also be provided with upstanding stabilizing legs 153 adapted to engage anchoring grooves 134 that can be provided in the underside of the rails 114, 116 for enhancing the attachment of the angle bracket 132 to the underside of the rail 114, 116.

The tongue member 142 and mounting arm 144 of the angle bracket 132 are, in the example illustrated, generally perpendicular to each other. This angulation is adapted to provide a generally vertical engagement axis 140 for a generally horizontal rail 114, 116. In other configurations, such as, for example, where the rail 114, 116 is at an incline, the angulation between the tongue member 142 and mounting arm 144 can be adjusted or offset from the perpendicular to match the degree of inclination of the rail 114, 116.

The angle bracket 132 can be constructed of a strong, tough material, such as metal or reinforced plastic. The tongue member 142 and mounting arm 144 can be integral or separate elements joined together. In the example illustrated, the angle bracket 132 is of unitary, one-piece stainless steel construction.

Figure 8:
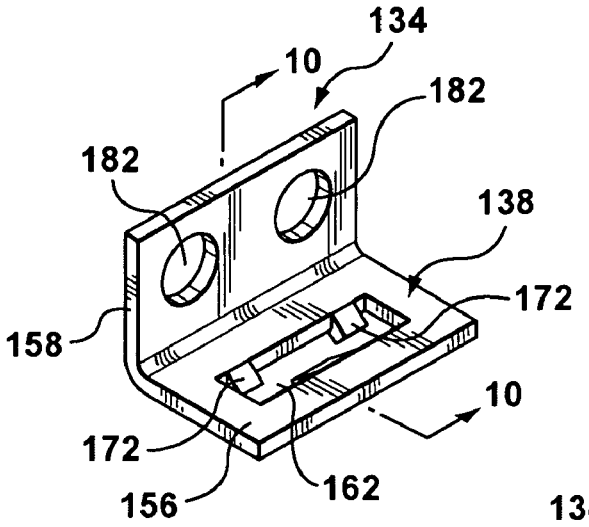
FIG. 8 is a perspective view of a second part of the connector apparatus of FIGS. 3 and 4.
Figure 9:
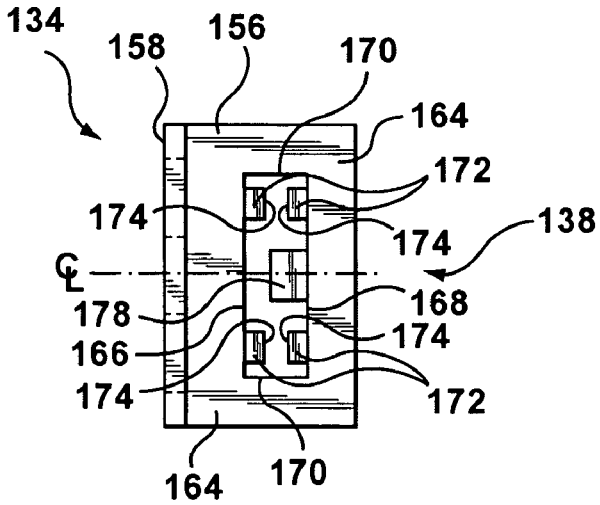
FIG. 9 is a front view of the second part of FIG. 8.
Figure 10:
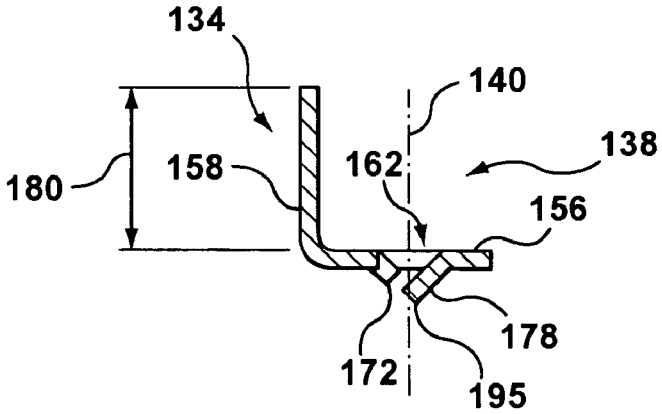
FIG. 10 is a side view in cross-section of the second part of FIG. 8, taken along the lines 10-10.

As best seen in FIGS. 8, 9, and 10, in the illustrated example, the second engagement element 138 of the keeper 134 comprises an engagement body 156 that is joined to a mounting base 158 of the keeper 134. The engagement body 156 has a cavity 162 for receiving the tongue member 142 of the first engagement element 136. The cavity 162 can be in the form of a slot extending through the engagement body 156, and having a support perimeter 164 around the slot. The support perimeter can provide the slot with a periphery including a proximal edge 166 nearest the mounting base 158, a distal edge 168 opposite the proximal edge 166, and opposed side edges 170 extending between the proximal and distal edges 166, 168.

The slot 162 can be at least slightly oversized with respect to the size of the tongue member 142 to facilitate insertion of the tongue member 142 in the slot 162. In the example illustrated, the spacing between the proximal and distal edges 166, 168 is greater than the corresponding thickness dimension 147 (FIG. 7) of the tongue member 142. The spacing between the opposed side edges 170 is slightly greater than the width 145 of the tongue member 142.

The engagement body 156 can be provided with opposed pressure tabs 172 along the proximal and distal edges 166, 168, extending from the edges 166, 168 towards the center of the slot. The pressure tabs 172 can be inclined downwardly to provide a guide or lead for insertion of the tongue member 142. Opposed innermost ends 174 of the pressure tabs 172 can be spaced such that the pressure tabs 172 are adapted to bear against the bearing surface 148 of the tongue member 142 when the connector 130 is in the engaged position. At least one tab 172 extends inwardly of the cavity 162 from the proximal edge 166 (i.e. opposite the barb 178) and laterally offset relative to the barb 178 to engage the bearing surface 148 aside the retaining aperture 146.

The second engagement element 138 of the keeper 134 can include a locking tab or barb 178. The barb 178 can be adapted to, when the connector 130 is in the engaged position, invade the retention aperture 146 of the tongue member 142 of the first engagement element 136. In the illustrated example, the locking barb 178 is cantilevered from the distal edge 168 of the cavity 162, and is inclined downwardly and inwardly (similar to the pressure tabs 172). The barb 178 is moveable between advanced and retracted positions by, in the example illustrated, bending or flexing generally about the connection of the barb 178 to the distal edge 168.

The barb 178 can be biased towards the advanced position, in which the barb 178 extends laterally towards the proximal edge 166 a sufficient distance to impede free insertion of the tongue element 142 into the cavity 162. In use, the tongue element 142 can be forced into the cavity 162 along the engagement axis 140, moving the barb 178 from the advanced to the retracted position. Once the tongue element 142 is inserted a sufficient amount (i.e. moved into position corresponding to the engaged position), the retention aperture 146 can be aligned with the barb 178, allowing the barb 178 to move back to the advanced position.

The upper rail 116 can be of multiple-piece construction. In the example illustrated, the upper rail 116 includes a core 134 and a cover 136. The core 134 has a core top wall 138 and opposed core sidewalls 140 depending from the core top wall 138. The core sidewalls 140 are spaced apart to receive upper ends of the balusters 118 therebetween. The core top wall 138 has an underside 142 that can include features similar to that of the underside 130 of the intermediate web 128, namely, the elongate central boss 132 and anchoring grooves 134 on either side thereof.

The cover 136 has a cover top wall and opposed cover sidewalls depending downwardly from either side thereof.

The balusters 118 can be secured to the core by driving fasteners through the top wall of the core and into the upper ends of the balusters. The top wall can have a central elongate recess in its upper surface to accommodate the heads of the fasteners.

The mounting base 158 of the keeper 134 can be a generally planar member adapted to bear in flush engagement against the upright 120. The mounting base 158 in the illustrated example has a height 180 measured generally parallel to the engagement axis 140. The mounting base 158 can be provided with least one aperture 182 to receive a fastener 184 for mounting the keeper 134 to the upright 120.

Figure 11:
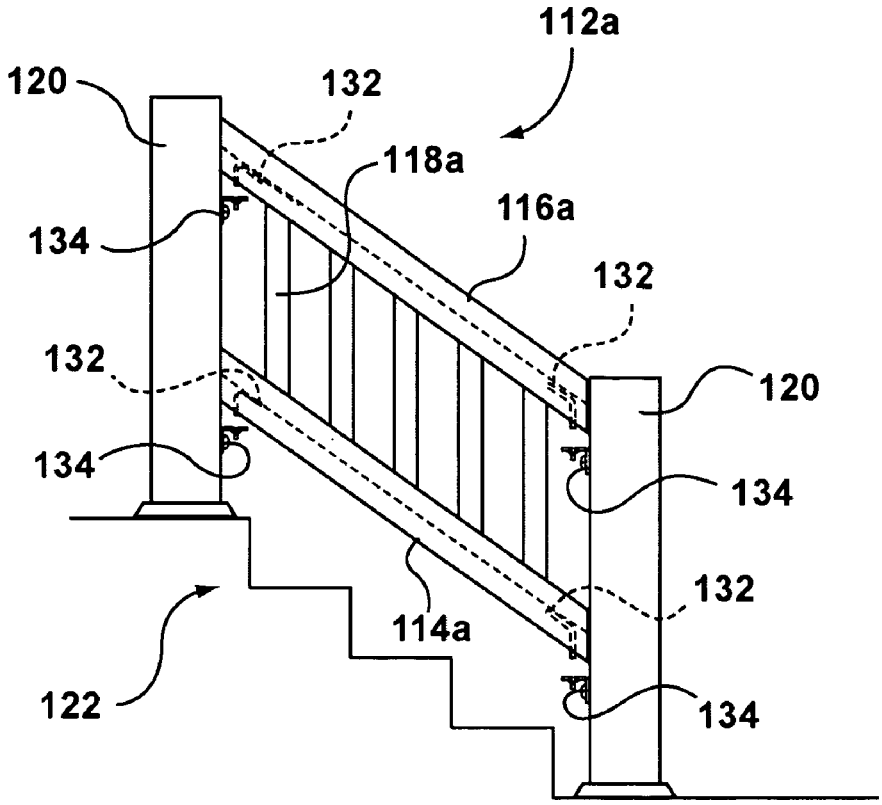
FIG. 11 is a side view of a portion of the railing system of FIG. 1, shown in a disengaged position.

Referring now also to FIG. 11, a method for installing the railing system 110 will be described. First and second posts 120 can be installed, for example, at upper and lower ends of a staircase. The posts 120 can be secured to the staircase by, for example, a steel anchor having a flange to be bolted to the staircase, and an upstanding support member that can engage a hollow interior of the upright 120 to support the upright 120 from within.

The horizontal distance between the uprights 120 and the incline of the staircase can be measured and used to pre-assemble the railing section 112*a*. The lower and upper railings 114, 116 can be cut to length, and the end faces thereof can be mitered so as to abut the adjacent surfaces of the uprights 120 in flush engagement when installed. The balusters 118 can be secured to the railings 114, 116. The first part 132 of each of four connectors 130 can be secured to the respective ends of each of the railings 114, 116, by installing the fasteners 154.

The second part 134 of each of the four connectors 130 can be secured to the adjacent surface of the uprights 120 (by installing the fasteners 184), two parts 134 on each upright 120 and spaced vertically apart to match the vertical spacing between the first parts 132 on the lower and upper railings 114, 116 at each end of the railing sections 112*a*, 112*b*.

Figure 11A:
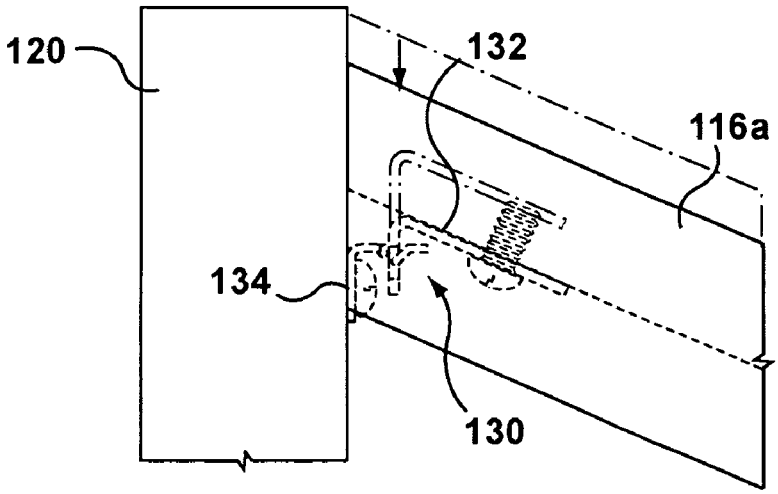
FIG. 11*a* is an enlarged view of a portion of the railing system of FIG. 11, shown in an engaged position.

After installing the fasteners 154 and 184, the railing sections 112*a*, 112*b* can be moved to a position with the ends of the railings 114, 116 aligned between, but to one side of, the uprights 120, and with the lower and upper railings 114, 116 above the respective lower and upper pairs of second parts 134 of the connectors 130. The railing sections 112*a*, 112*b* can then be translated (generally horizontally), so that the end faces of the railings 114, 116 are flush with the inwardly directed faces of the uprights 120, and the first engagement elements 136 of the first parts 132 are registered with the second engagement elements 138 of the second parts 134 (i.e. the tongue member 142 in vertical alignment above the cavity 162). The railing sections 112*a*, 112*b* can then be lowered so that the first engagement elements 136 are moved along the engagement axis 140 towards the second engagement elements 138, thereby moving the connectors 130 from the disengaged position (FIG. 11) to the engaged position (FIG. 11*a*).

Once in the engaged position, the barb 178 can engage the retention aperture 146 as discussed previously. The barb 178 can prevent upward vertical movement by abutment of its lower edge against a lower peripheral edge 146*a* of the retention aperture 146. The lower peripheral edge 146*a* provides a catch surface to engage the lower edge of the barb 178, preventing withdrawal of the tongue from the cavity along the engagement axis. The opposed side edges 170 of the slot 162 can provide lateral abutment surfaces against which respective side edges 145*a* and 145*b* can abut to inhibit lateral motion (i.e. motion generally transverse to the engagement axis 140 and generally transverse to the longitudinal axis of the railings 114, 116) when the railing system 110 is under load. The pressure teeth 172 can bear against the bearing surface 148 of the tongue member 142 to facilitate engagement of the first and second engagement elements and to hold the first and second engagement elements in stable relative positioning such that the barb 178 remains vertically registered with edge 146*a*.

Figure 2A:
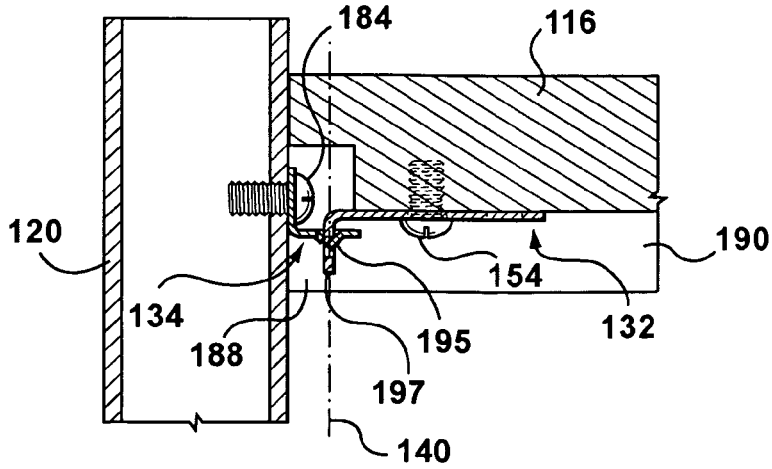
FIG. 2*a* is a side view in cross-section of the portion of the system of FIG. 2 in a non-exploded state.

The concealed aspect of the connector 130 can best be understood with reference to FIGS. 2 and 2*a*. The slide connector 130 has a compact vertical extent that facilitates concealment in the assembled railing system 110. Each rail 114, 116 in the illustrated example has a pocket 188 in its underside, straddled on either side by downwardly extending sidewalls 190. The pocket 188 is adapted to accommodate at least a portion of the first part 132 of the connector 130, and can have an elongate central boss 192 with anchoring grooves 194 on either side. The boss 192 can be adapted to receive the fasteners 154, and the anchoring grooves 194 can be adapted to receive the upstanding stabilizing legs 153. Engagement of the stablilizing legs 153 in the anchoring grooves 194 can reinforce and strengthen the attachment of the first part 132 to the rail 114, 116. The sidewalls 190 can conceal at least a portion of the first part 132 and the fasteners 154.

As well, the sidewalls 190 can conceal at least a portion of the second part 134 of the connector 130 in the assembled railing system 110. The second part 134 has a vertically lowermost extent 195 that is generally defined by the lowermost or leading edge of the barb 178. The lowermost extent 195 will generally be at an elevation above the lowermost vertical extent 197 of the first part 132, which is defined by the lowermost or leading edge of the tongue member 142. Thus providing a sidewall depth that is of sufficient vertical extent to conceal or substantially conceal the first part 132 and will also be sufficient to conceal the second part 134 of the connector 130 in the assembled railing system 110. In the example illustrated, the fasteners 184 for securing the second part 134 to the upright 120 are positioned vertically above the second engagement means 138 of the second part 134, and are also readily concealed from view by accommodation within the pocket 188.

Figure 14:
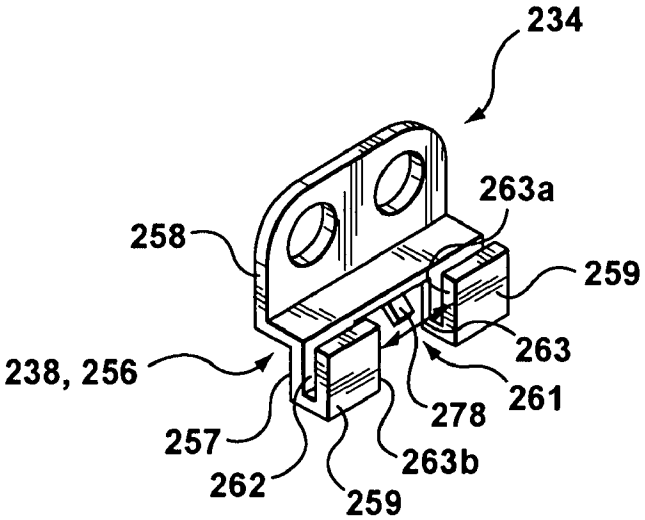
FIG. 14 is a perspective view of a second part of the connector apparatus of FIG. 12.
Figure 13:
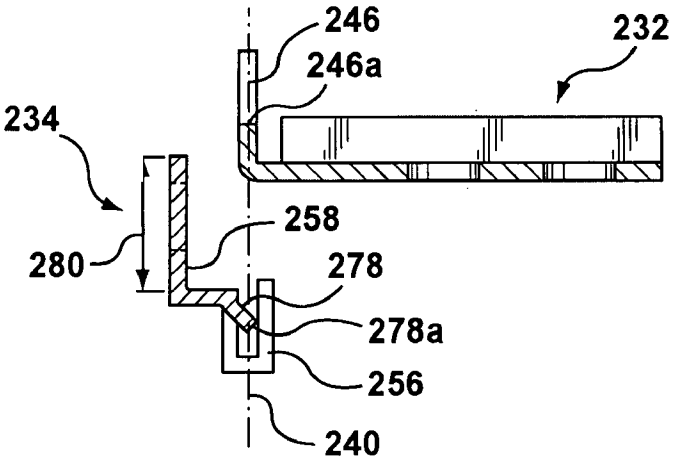
FIG. 13 is a side view in cross-section of the apparatus of FIG. 12, taken along the lines 13-13.
Figure 12:
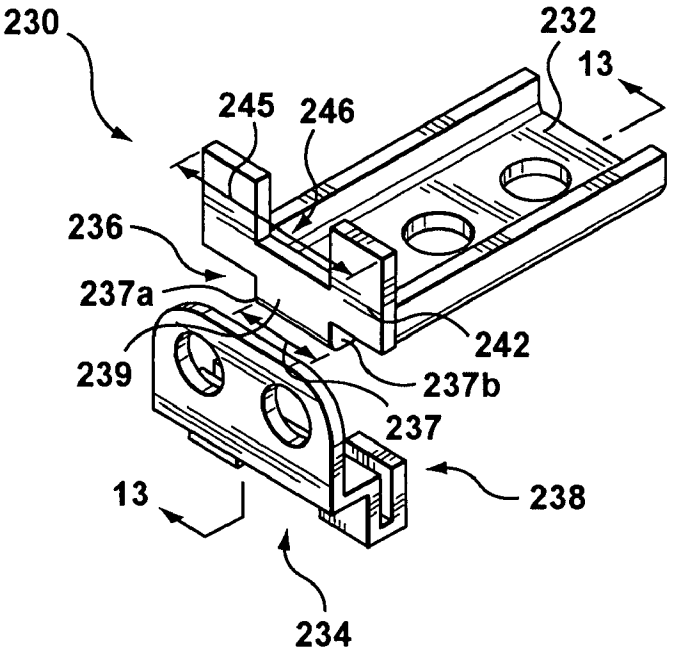
FIG. 12 is a perspective view of an alternate example of a connector apparatus in accordance with the present specification, shown in a disengaged position.

Referring now to FIGS. 12-14, an alternate example of a slide connector 230 can be seen. The slide connector 230 has similar elements as the connector 130, and like features are identified by like reference characters incremented by 100.

The first engagement element 236 of the angle bracket 232 includes a tongue member 242 that extends vertically upwards from the mounting arm 244 when installed in the railing system 110. The tongue member 242 has a width 245, and is joined to the mounting arm 244 by a web 239. The web 239 has a width 237 that is narrower than the width 245 of the tongue 242. The width 237 of the web 239 extends between opposed web side edges 237*a* and 237*b*.

The tongue member 242 has a retention aperture 246 in the form of a slot having a lower peripheral edge 246*a* opposite an open upper end.

The second engagement element 238 of the keeper 234 of the connector 230 includes an engagement body 256 having a generally U-shaped configuration and defining a cavity 262 therein. The cavity 262 is adapted to receive the tongue 242 of the first engagement element 236. The body 256 has a proximal wall 257 (nearest the mounting base 218) and a distal wall 259 opposite the front wall 257. The distal wall 259 has a channel 261 what is open at its upper end to admit the web 239 of the first engagement means 236. The channel 261 has a width 263 extending between opposed channel edges 263*a* and 263*b*. The channel width 263 is slightly greater than the web width 237.

In the engaged position, the leading edge 278*a* of the barb 278 abuts the lower edge 246*a* of the aperture 246 so as to prevent vertically upward movement of the first part 232 relative to the second part 234. The edges 263*a*, 263*b* provide lateral abutment surfaces that can bear against the web edges 237*a*, 237*b*, respectively, to restrict lateral movement of the first part 232 relative to the second part 234.

Figure 15:
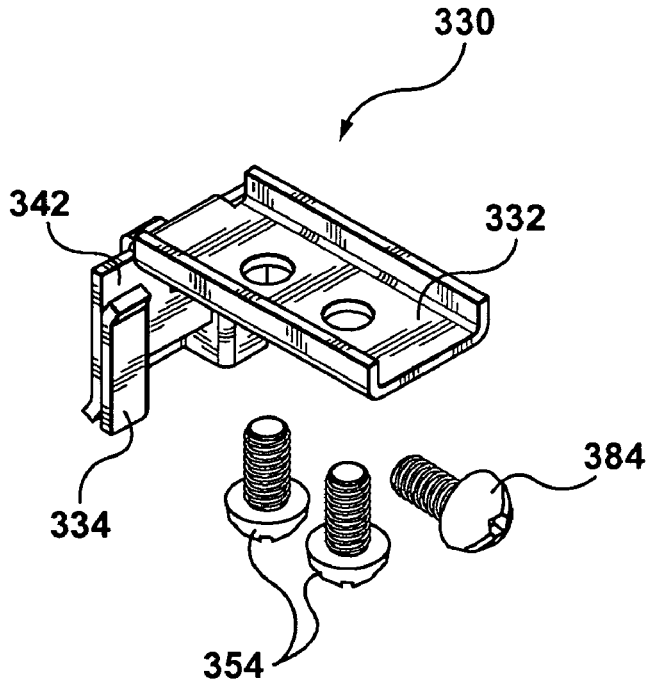
FIGS. 15 and 16 are perspective and side views, respectively, of another alternate example of a connector apparatus in accordance with the present specification.
Figure 16:
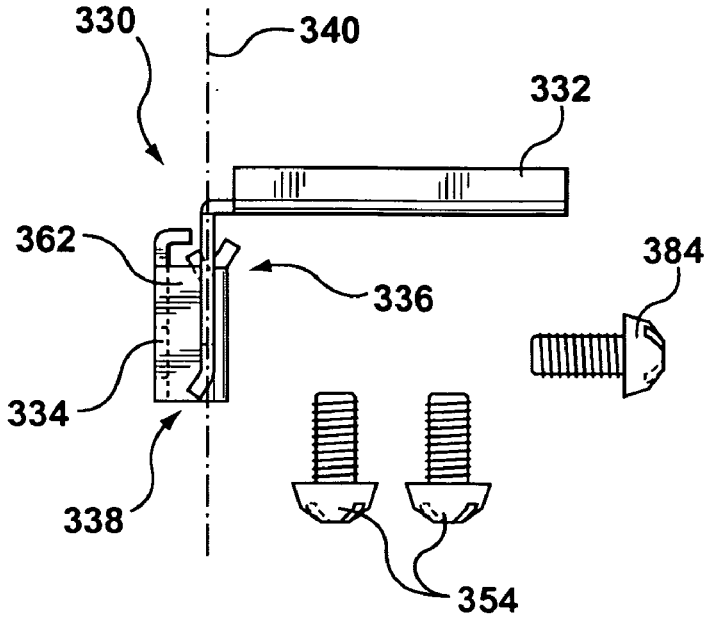

Referring now to FIGS. 15 and 16, another alternate example of a slide connector 330 according to the present teaching can be seen. The connector 330 has similar elements as the connector 130, and like features are identified by like reference characters incremented by 200.

Figure 17:
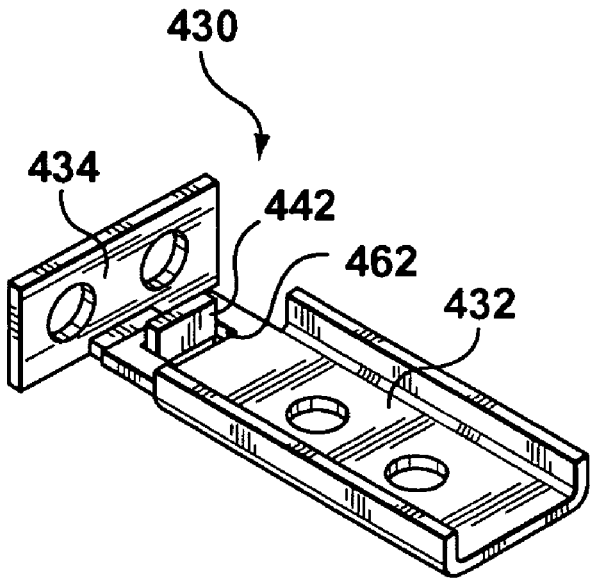
FIGS. 17 and 18 are perspective and side views, respectively, of another alternate example of a connector apparatus in accordance with the present specification.
Figure 18:
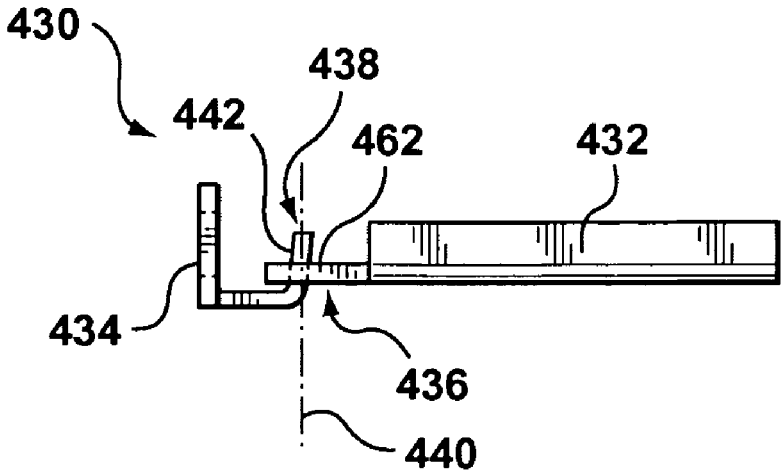

Referring now to FIGS. 17 and 18, another alternate example of a slide connector 430 according to the present teaching can be seen. The connector 430 has similar elements as the connector 130, and like features are identified by like reference characters incremented by 300.

While the above description provides examples of one or more processes or apparatuses, it will be appreciated that other processes or apparatuses may be within the scope of the accompanying claims.

We claim:

1. In combination, a rail, an upright, and a slide connector for attaching the rail to the upright, the slide connector comprising:

a) a first part mounted to the rail and having a first engagement element; and b) a second part mounted to the upright and having a second engagement element, the first and second engagement elements adapted to be coupled by moving the second engagement element in a direction parallel to a generally vertical plane into contact with the first engagement element, c) wherein the first engagement element comprises a tongue and the second engagement element comprises a cavity adapted to receive the tongue, d) wherein the first part comprises a mounting arm secured to an underside surface of the rail, the first engagement element depending from the mounting arm and defining the tongue, e) wherein the second part comprises a mounting base secured to a side surface of the upright, the second engagement element extending laterally outwardly from the mounting base, f) wherein the second engagement element defines a support perimeter around the cavity, the second engagement element further including a barb extending from the support perimeter inwardly of the cavity, g) wherein the first engagement element comprises a retention aperture in the tongue, the barb adapted to invade the retention aperture upon insertion of the tongue into the cavity, and h) wherein the second engagement element comprises at least one pressure tab extending inwardly of the cavity from a side of the cavity generally opposite the barb and laterally offset with respect to the barb to urge the tongue towards the barb.

2. The combination of claim 1, wherein the first and second parts are secured to the rail and the upright, respectively, prior to coupling together the first and second engagement elements.

3. The combination of claim 2, wherein the rail is inhibited from moving relative to the upright when the first and second parts are coupled together.

4. The combination of claim 3, wherein the tongue depends generally vertically downwardly from the mounting arm, wherein the first and second engagement elements are coupled by vertically downward movement of the tongue into the cavity.

5. The combination of claim 4, wherein when coupled, the barb has a lowermost edge above and in vertical registration with a bottom edge of the retention aperture, wherein vertical movement in a direction withdrawing the tongue from the cavity is inhibited by abutment of the lowermost edge of the barb with the bottom edge of the retention aperture.

6. The combination of claim 5, wherein the cavity has opposed side edges presenting lateral abutment surfaces facing respective side edges of the tongue, wherein lateral motion of the rail relative to the post is inhibited.

7. The combination of claim 1, wherein an underside surface of the mounting arm is in vertical registration with an upper surface of the support perimeter for bearing thereagainst when the first and second engagement elements are coupled.

* * * * *